US005644348A

United States Patent [19]

Shimoyama et al.

[11] Patent Number: 5,644,348

[45] Date of Patent: Jul. 1, 1997

[54] CONTROL OF PRINT CARTRIDGE MOVEMENT IN AN INK JET RECORDING APPARATUS

[75] Inventors: Noboru Shimoyama, Yokohama; Masanori Kaneko, Kawasaki, both of Japan

[73] Assignee: Canon Kabushiki Kaisha, Tokyo, Japan

[21] Appl. No.: 594,332

[22] Filed: Jan. 30, 1996

Related U.S. Application Data

[63] Continuation of Ser. No. 332,492, Oct. 31, 1994, abandoned, which is a continuation of Ser. No. 140,988, Oct. 25, 1993, abandoned, which is a continuation of Ser. No. 709,228, Jun. 3, 1991, abandoned.

[30] Foreign Application Priority Data

Jun. 1, 1990 [JP] Japan ..... 2-144610
May 17, 1991 [JP] Japan ..... 3-113231

[51] Int. Cl.[6] ..... B41J 2/165; B41J 19/18

[52] U.S. Cl. ..... 347/37; 400/76; 400/279; 400/322; 400/582; 347/104

[58] Field of Search ..... 400/76, 185, 320, 400/322, 279, 328, 319, 582, 61, 701, 702; 347/23, 33, 37, 101, 104

[56] References Cited

U.S. PATENT DOCUMENTS

| | | | |
|---|---|---|---|
| 4,313,124 | 1/1982 | Hara . | |
| 4,324,500 | 4/1982 | Moon et al. | 400/583 |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,639,151 | 1/1987 | Ueno et al. | 400/61 |
| 4,692,777 | 9/1987 | Hasumi | 347/23 |
| 4,723,129 | 2/1988 | Endo et al. . | |
| 4,740,796 | 4/1988 | Endo et al. . | |
| 4,741,633 | 5/1988 | Shibuya et al. . | |
| 4,785,312 | 11/1988 | Toyomura | 400/279 |
| 4,870,611 | 9/1989 | Martin | 364/900 |
| 5,018,884 | 5/1991 | Hirano et al. | 347/37 |
| 5,019,839 | 5/1991 | Watanabe | 346/134 |
| 5,140,344 | 8/1992 | Tsukada et al. | 347/37 |
| 5,245,362 | 9/1993 | Iwata et al. | 347/23 |
| 5,404,229 | 4/1995 | Ono et al. | 347/23 |
| 5,459,496 | 10/1995 | Hanabusa et al. | 347/23 |

FOREIGN PATENT DOCUMENTS

| | | | |
|---|---|---|---|
| 2905057 | 8/1979 | Germany | 400/279 |
| 3503080 | 8/1985 | Germany | 400/701 |
| 3607228 | 9/1987 | Germany | 400/701 |
| 58-171964 | 10/1983 | Japan | 347/23 |
| 62-077940 | 4/1987 | Japan | 347/23 |
| 62-242541 | 10/1987 | Japan | 347/37 |
| 292438 | 12/1987 | Japan | 400/701 |
| 1-040339 | 2/1989 | Japan | 347/23 |
| 1-308673 | 12/1989 | Japan | 347/37 |
| 3-246040 | 11/1991 | Japan | 347/104 |

OTHER PUBLICATIONS

"Reverse Tab & Multi–Column Justification Handling for a Bidirectional Printer", IBM Technical; Disclosure Bulletin, vol. 22, No. 5 Oct. 1979, p. 1764.

*Primary Examiner*—David A. Wiecking
*Attorney, Agent, or Firm*—Fitzpatrick, Cella, Harper & Scinto

[57] ABSTRACT

An ink jet recording apparatus for recording onto a recording medium by discharging ink includes a recorder for recording on the recording medium by discharging the ink through discharge ports, a setting device for setting a line recording mode in which recording is performed for every line or a page recording mode in which the recording is performed over a plurality of lines, with the recorder, and a controller, which, when the line recording mode is set, moves the discharging port face of the recorder outside of a conveyance passage for the recording medium for every termination of recording of one line, and which, when the page recording mode is set, reciprocates the recorder in the conveyance passage to record over a predetermined area, and after termination of recording of the predetermined area, moves the discharging port face of the recorder outside of the conveyance passage, and then conveys the recording medium for discharge from the apparatus.

25 Claims, 8 Drawing Sheets

CONTROL OF PRINT CARTRIDGE MOVEMENT IN AN INK JET RECORDING APPARATUS

This application is a continuation of application Ser. No. 08/332,492, filed Oct. 31, 1994, which is a continuation of application Ser. No. 08/140,988 filed Oct. 25, 1993, which is a continuation of application Ser. No. 07/709,228 filed Jun. 3, 1991, all now abandoned.

BACKGROUND OF THE INVENTION

1. Field of the Invention

The present invention relates to a recording apparatus for use with the recording of a character or an image, and an electronic typewriter having such a recording apparatus.

2. Related Background Art

Conventionally, a recording apparatus for recording onto a recording medium such as paper or an OHP sheet (hereafter referred to as a recording sheet or simply as a paper) mounted on the electronic typewriter or word processor has been proposed in which the recording head is mounted in accordance with various recording methods. There are recording heads based on wire-dot, thermal, thermal imprint and ink jet recording methods.

The ink jet recording method which directly discharges ink onto a recording sheet, has a low running cost and performs quietly.

An electronic typewriter, for example, on which a recording apparatus having such an ink jet recording head is mounted, performs predetermined recording by feeding a recording sheet of predetermined size to a recording position, and scanning with the recording head in both directions while conveying the recording sheet in accordance with a record signal. If the recording on the recording sheet is terminated, and the recording sheet is exhausted, a next recording sheet is fed to a recording position for subsequent recording. In this case, in exhausting the recording sheet, a trailing end portion of paper passing between pinch rollers comes into contact with ink discharge ports in the ink jet recording head. As a result of this contact, there is the possibility of a failure in conveying the sheet or of damage to the discharge port face.

A technique for solving such a problem is that in a recording area where recording is performed and opposed to the recording head in the conveyance passage for the recording sheet, suction means is provided, and the recording sheet is conveyed by suction so that the trailing end portion of the recording sheet does not come into contact with the head.

Also, in recording onto the entire recording area of the recording sheet, when the last line is recorded, recording is performed with a trailing end portion of the recording sheet being pressed. And when the recording of the last line has been finished, the recording head, which has moved to a non-record area off the recording area, is caused to return to an area called a home position which is a non-record area, positioned in the non-record area or opposite to the non-record area off the recording area, and where a head cap member or a head cleaning member is arranged, so as not to reduce the throughput. It has been proposed that the recording sheet be exhausted at the same time that the recording head returns.

By the way, in the case where upon termination of recording, the recording head is returned at a high speed and at the same time the recording sheet is exhausted, if the recording head is positioned in the area opposite to the home position when the recording head has recorded over the entire area of maximum recording width, the fast return operation of the head and the exhaust of the recording sheet may sometimes be concurrently carried out. In this case, if the recording sheet is jammed, then the jammed recording sheet may come into contact with the discharge port face of the recording head and damage the discharge port face.

SUMMARY OF THE INVENTION

An object of the present invention is to provide a recording apparatus capable of performing excellent recording in both directions and an electronic typewriter having the recording apparatus.

Another object of the present invention is to provide a recording apparatus capable of exhausting a recording medium in an excellent manner and an electronic typewriter having such a recording apparatus.

Another object of the present invention is to provide a recording apparatus in which a recording medium does not come into contact with a recording head when the recording medium is exhausted, and an electronic typewriter having such a recording apparatus.

Another object of the present invention is to provide a recording apparatus capable of shortening the recording time by manipulating the reciprocatory range of the recording head during recording, and an electronic typewriter having such a recording apparatus.

The present invention has been proposed to improve the aforementioned problems, in which it is an object of the invention to provide a recording apparatus which can print in both directions and is compact, wherein the recording apparatus is capable of avoiding various technical problems due to the contact between a trailing end of the recording medium and a recording head in exhausting the recording medium, with a simple constitution, and an electronic typewriter mounting such a recording apparatus thereon.

DETAILED DESCRIPTION OF THE PREFERRED EMBODIMENTS

An embodiment of the present invention as described below is characterized in that if trailing end detection means for detecting the passage of a trailing end of a recording medium detects that the trailing end of the recording medium has passed, a determination is made whether the recording head exists within a recording area opposed to the recording medium, and if the recording head exists within the recording area, a carriage having the head mounted therein is driven so that the recording head is moved to an area out of the recording area (the area out of a conveyance passage of the recording medium), and then the recording medium is conveyed.

Also, an embodiment will be described below which is characterized by a rightmost end portion of the recording medium, which is an area opposed to the recording head being defined as the return area of the carriage, and when the trailing end detection means detects a trailing end of the recording medium, the recording head is moved to an area opposed to a cap member provided on a non-recording area.

Moreover, an embodiment will be described below of an electronic typewriter on which a recording apparatus is mounted and operating in a line recording mode in which an image can be formed for every line, and in a shift recording mode in which an image of several lines can be formed once. The apparatus also operates in a trailing end detection cancel mode corresponding to execution of the line recording mode in which detection means for detecting the trailing end portion of the recording medium is not operated, and operates in a trailing end detection mode corresponding to execution of the shift recording mode in which detection means for detecting the trailing end portion of the recording medium is operated.

With the above constitution, the time at which the recording head is returned and at which the recording medium is exhausted is adjusted, and contact between the head discharge port face and the trailing end portion of the recording medium is surely avoided, and on the side opposite to the home position of the recording apparatus via interposition of the recording area, there is no need for a space in which the recording head escapes from the recording medium. As a result, the recording apparatus can be miniaturized.

A preferred embodiment of the present invention will be described in detail with reference to the drawings.

(General Description)

First, there is provided a general description of an electronic typewriter to which an embodiment of the present invention is applied.

Figure 1A:
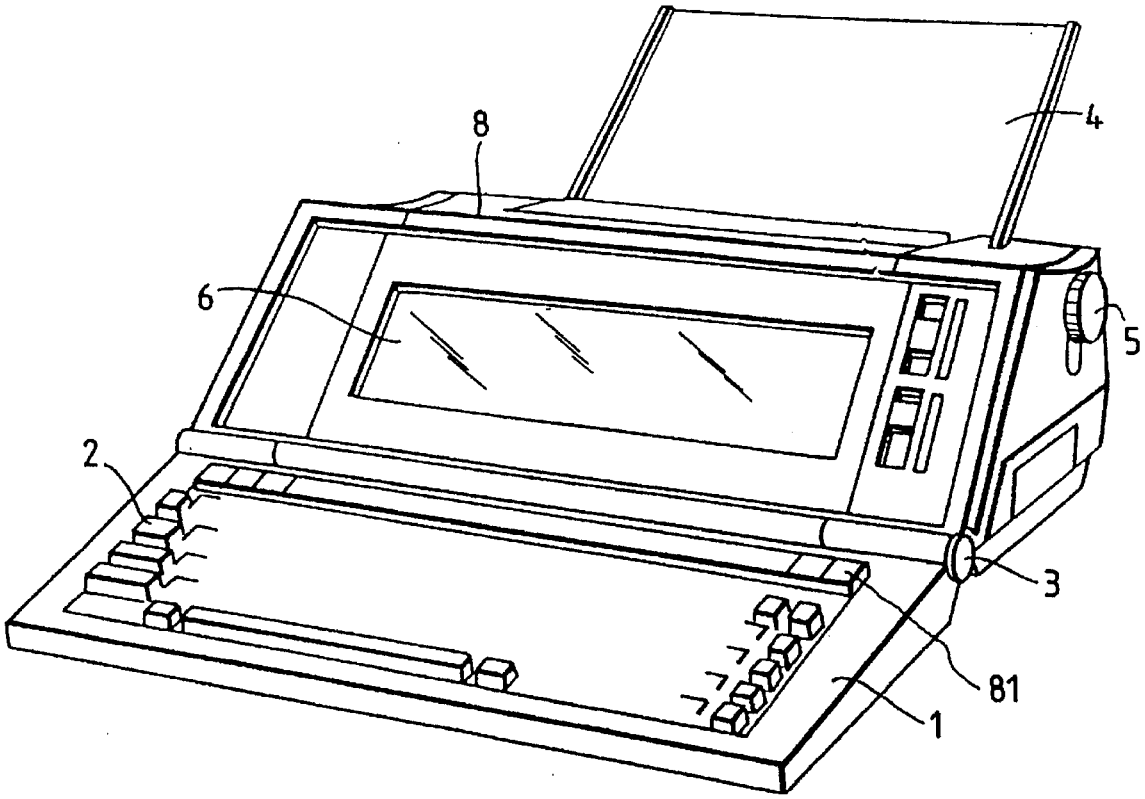
FIGS. 1A and 1B are external perspective views showing an electronic typewriter of an example according to the present invention, when in use and storage.
Figure 1B:
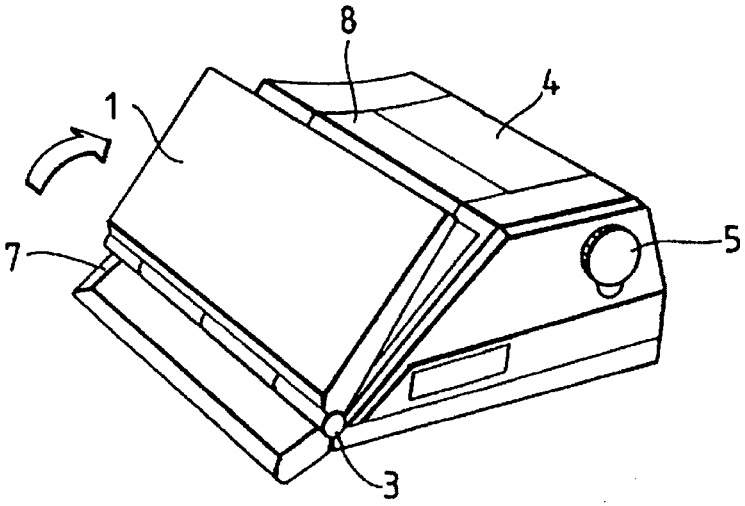

FIGS. 1A and 1B show a schematic external view of an electronic typewriter with a recording apparatus to which this invention is applicable. Here, 1 denotes a keyboard section in which is arranged a group of keys 2, such as keys for entering characters, e.g. letters and numerals, a print command key, e.g. a return key, various control keys, and a switch key 81 for switching between the line recording mode and the page recording mode as will be described later. When not used, the keyboard section 1 can be folded over a display section 6 by turning it around a hinge 3, as shown in FIG. 1B. 4 denotes a paper feed tray for supporting a sheet-like recording medium to be fed to a recording unit of an electronic typewriter. This paper feed tray 4 can be also stored therein so as to cover an upper portion of the recording unit, as shown in FIG. 1B, when not used. 5 denotes a feeder knob for setting the recording medium to a recording position or exhausting it therefrom manually, which is used to convey the recording medium in an exhausting or an opposite direction manually by the operator turning it in the clockwise or counterclockwise direction, 6 denotes a display for displaying texts input by the key operator or from floppy disk 1A, and 7 denotes a handle used to transport the typewriter of this embodiment.

Figure 2:
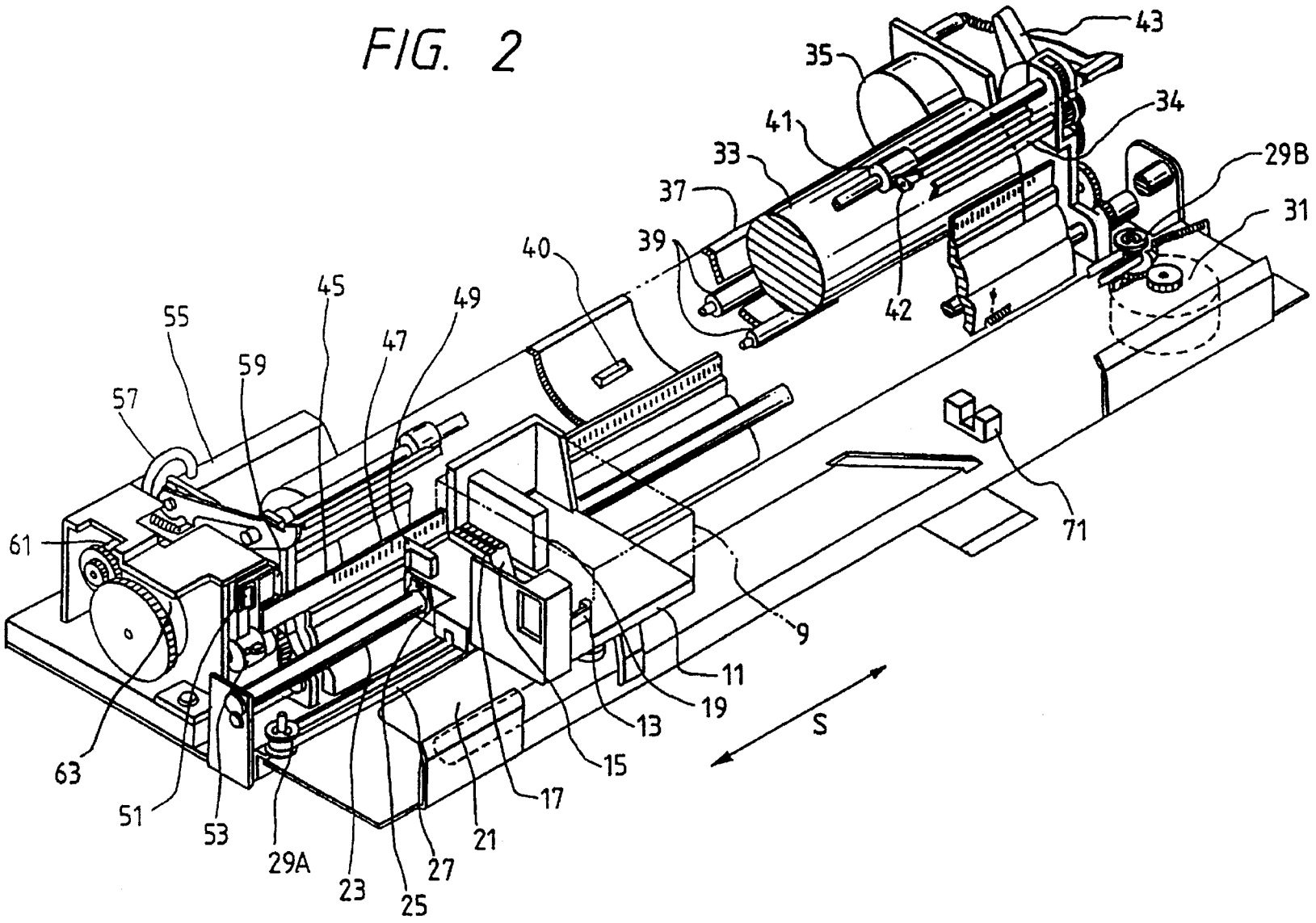
FIG. 2 is a perspective view showing one constitutional example of a recording apparatus which is applicable in the present invention.

FIG. 2 is a schematic perspective view showing a recording unit extracted from an electronic typewriter.

Here, 9 denotes a head cartridge in which an ink jet recording head and an ink tank for storing ink to be supplied to the head are integrally formed, and which is loaded detachably onto a carriage 11. And the carriage 11 can scan in the S direction in FIG. 2 with the head cartridge 9 mounted thereon. The ink jet recording head for use with this embodiment discharges the ink through discharge ports (not shown) by the use of heat energy, and is of the type in which electricity-heat converters for generating the heat energy are provided. The recording head drives (or heats) the electricity-heat converters in accordance with a recording signal, causing film boiling and discharging the ink through discharge ports by the use of a pressure change caused by the generation of bubbles. 13 denotes a hook for mounting the head cartridge 9 onto the carriage 11, and 15 denotes a lever for operating the hook 13. On this lever 15 is provided a marker 17 for enabling a print or set position of the recording head in the head cartridge to be read with the indication of a scale provided on a cover as will be described later. 19 denotes a support plate for supporting an electrical connection section (not shown) to the head cartridge 9. 21 denotes a flexible cable for connection between its electrical connection section and a control section of the main body.

23 denotes a guide shaft for guiding the carriage 11 in the S direction, which is inserted through bearings 25 of the carriage 11. 27 denotes a timing belt for transmitting the power to move the carriage 11 fixed thereto in the S direction, looped under tension about pulleys 29A, 29B disposed on both side portions of the apparatus. A driving force is transmitted to one pulley 29B via a transmission, e.g. a gear, by a carriage motor 31.

71 denotes a carriage sensor using a photo interrupter, which can set a position reference for carriage 11 with a protruding portion (not shown) provided on a bottom surface of carriage 11 passing by the carriage sensor 71.

33 denotes a conveying roller for conveying the recording medium, e.g. paper (hereinafter referred to as a recording sheet) in recording, as well as regulating a record plane of the recording medium, and which is driven by a conveying motor 35. 37 denotes a paper pan for conducting the recording medium from the paper feed tray 4 to a recording position. 40 denotes a detection sensor for detecting a trailing end of the recording medium. A CPU 100 as will be described later will recognize that the recording medium may come off a presser bar 45 as will be described later, in steps after the sensor 40 has detected the trailing end of the recording medium. That is, it can recognize a final recording line with the recording head by determining the area in which the recording medium may come off the presser bar 45 with the sensor 40. 39 denotes a feed roller, disposed in the conveyance path of the recording medium, for conveying the recording medium pressed therein against the conveying roller 33. 34 denotes a platen for regulating a recording face of the recording medium, opposed to a discharge port formation face of the head cartridge 9. 41 denotes an exhausting roller for exhausting the recording medium to a paper exhausting port, not shown, which is disposed downstream from the recording position in the direction of conveying the recording medium. 42 denotes a spur provided corresponding to the exhausting roller 41, for pressing the roller 41 via the recording medium, and developing a force for conveying the recording medium with the exhausting roller 41. 42 denotes a release lever for releasing the engagement between a feed roller 39, a presser bar 45 and a spur 42 in setting a recording medium, which is manipulatable by the operator.

45 denotes a presser bar for suppressing the floating of the recording medium in the neighborhood of the recording position to secure a close contact state against the conveying roller 33. In this example, an ink jet recording head for recording by the discharge of ink is used as the recording head. Accordingly, as the distance between the ink discharge port formation face of the recording head and a record surface of the recording medium is relatively slight, and must be strictly controlled to avoid contact between the recording medium and the discharge port formation face of the head, it is effective to press the recording medium against the conveying roller 33 by means of the presser bar 45. 47 denotes a scale provided on the presser bar 45, and 49 denotes a marker provided on the carriage 11 corresponding to this scale, both of them being used to enable a print or set position for the recording head to be read.

51 denotes a cap made of an elastic material, e.g. rubber, which is opposed to the ink discharge port formation face of the recording head placed in the home position, and supported so as to easily attach to/detach from the recording head. The cap 51 is used for protecting the recording head when not used, or in a suction recovery process for the recording head. It should be noted that the suction recovery process is one of removing discharge faulty factors by forcedly discharging the ink from the whole discharge ports, while driving energy generation elements provided inwardly of the ink discharge ports and generating the energy used for discharging the ink, apart from conducting the recording operation.

53 denotes a pump used to exert a suction force for the forced discharge of ink, and the ink is received within the cap 51 in the suction recovery process with the forced discharge of ink. 55 denotes a waste ink tank for reserving waste ink sucked by the pump 53, and 57 denotes a tube communicating between the pump 53 and the waste ink tank 55.

59 denotes a blade for wiping the discharging port formation face of the recording head. This blade 59 is held to be movable between a position for wiping during the movement of the head and projecting onto the recording head, and a retracted position not engaging the discharge port formation face. 61 denotes a motor, and 63 denotes a cam mechanism for driving the pump 53 and moving the cap 51 and the blade 59, with the power transmitted from the motor 61 is provided.

(Control Means)

Figure 3:
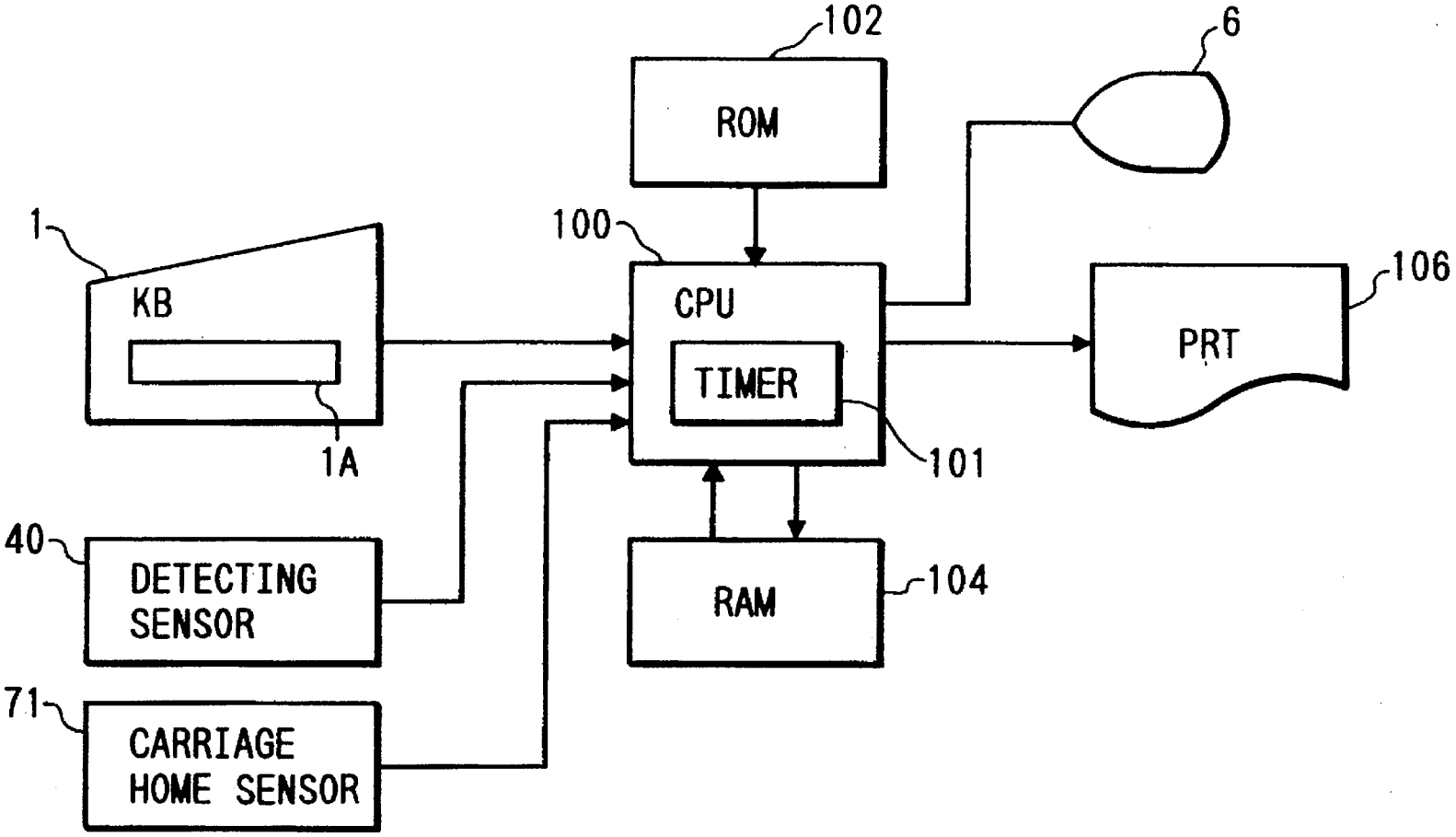
FIG. 3 is a block diagram showing a schematic constitutional example of a control system in an electronic typewriter of this example.

FIG. 3 shows a schematic constitutional example of a control block in a electronic typewriter of an embodiment according to the present invention.

Here, 100 denotes a CPU, for example, in the form of a microcomputer, for controlling each section in accordance with a processing procedure as will be described later in FIG. 4. 101 denotes a timer provided on the CPU 100 to be used for measuring the time during which there is no key input, and controlling the printer.

102 denotes a ROM for storing fixed data such as a character generator, as well as programs corresponding to processing procedures executed by the CPU 100. 104 denotes a RAM comprising the working area for the CPU 100, in addition to areas for development and management of data in printing. 106 denotes a recording apparatus mounting an ink jet recording head as described in FIG. 2. Also, the detection sensor 40 and the carriage sensor 71 as previously described can input detection signals into the CPU 100.

Thus, in this example, the driving of the carriage mounting the recording head 9 and the conveyance of the recording sheet are controlled by CPU 100 as above described.

A control example of this example will be now explained.

To begin with, the recording is started. A recording sheet is supplied from the feed side, and conveyed to a recording area where the recording is performed opposed to the recording head, by the conveying roller 33. On the other hand, waiting for the supply of the recording sheet, the recording sheet discharges the ink through discharge ports at predetermined timings in accordance with predetermined recording signals, while scanning with the carriage 11, to perform a desired recording operation. The recording sheet is sequentially conveyed and recorded, and the termination of the recording sheet is detected by a termination detection sensor 40 for the recording sheet provided in the conveyance passage for the recording sheet. If the termination of the recording sheet has been detected, the step at which a step motor 31 for scanning with the carriage 11 is placed is detected. From this detection result, if the carriage 11 exists within the recording area opposed to the recording sheet, the CPU 100 issues a command to the carriage step motor 31 which is a driving source for the carriage 11, in order to move the carriage 11 to the home position side where the cap member 51 exists. Note that the recording head 9 can not move to a rightmost portion of the maximum recording width for a recording sheet opposite to the home position, as will be described later. And after it is recognized that the carriage 11 has moved to the home position side, a command for exhausting the recording sheet is issued to exhaust the recording sheet. By performing such a control operation, the head 9 avoids contact with a trailing end portion of the recording sheet. Thus, the recording sheet can be prevented from being stained, or damaging the ink discharge port face of the head 9.

Figure 4A:
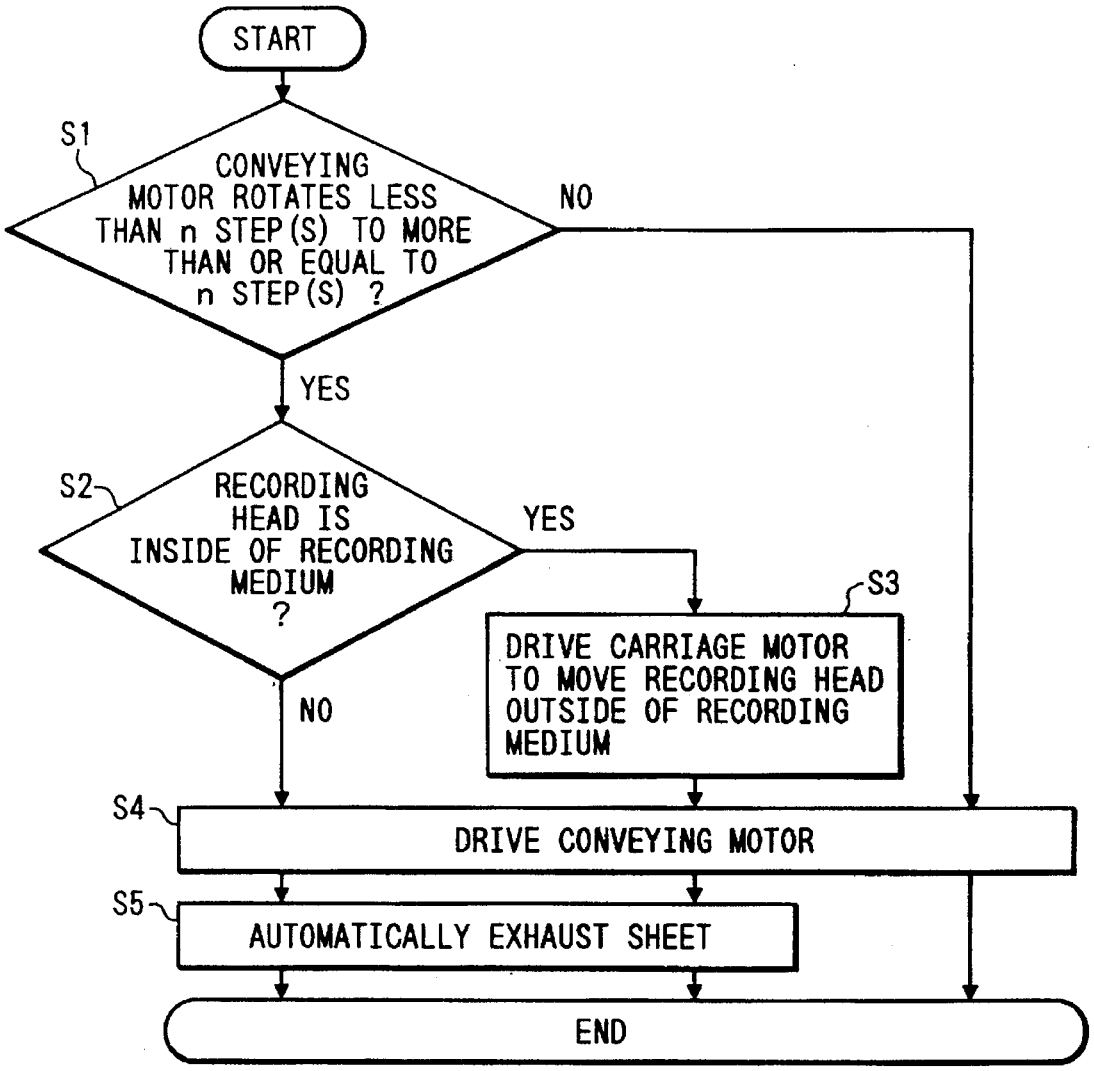
FIGS. 4A and 4B are flowcharts showing an example of a control procedure in this example, FIGS. 4B-1 and 4B-2 comprising FIG. 4B.

This control is briefly illustrated in the flowchart as shown in FIG. 4A. That is, the time when a drive command for the conveying motor 35 has been issued is considered as START. First, at step S1, a determination is made whether or not the rotation of conveying motor 35 is from less than n steps to more than or equal to n steps. If the rotation is from less than n steps to more than or equal to n steps, the procedure proceeds to step S2, where a determination is made whether the recording head 9 is inside of the recording area. And if the recording head 9 is inside of recording area, the procedure proceeds to step S3, where the carriage motor 31 is driven to move the recording head 9 outside of the recording area opposed to the recording medium. After completion of the movement, the procedure proceeds to step S4, where the conveying motor 35 is driven. In this case, the recording medium is then automatically exhausted (step S5).

If the recording head is outside of the recording area at step S2, the procedure proceeds directly to step S4, where the conveying motor 35 is driven, and afterwards, the recording medium is automatically exhausted (step S5).

If the rotation of the conveying motor 35 is not from less than n steps to more than or equal to n steps, at step S1, the procedure proceeds to step S5, where the conveying motor 35 is driven to convey the recording medium.

Figures 1, 4B:
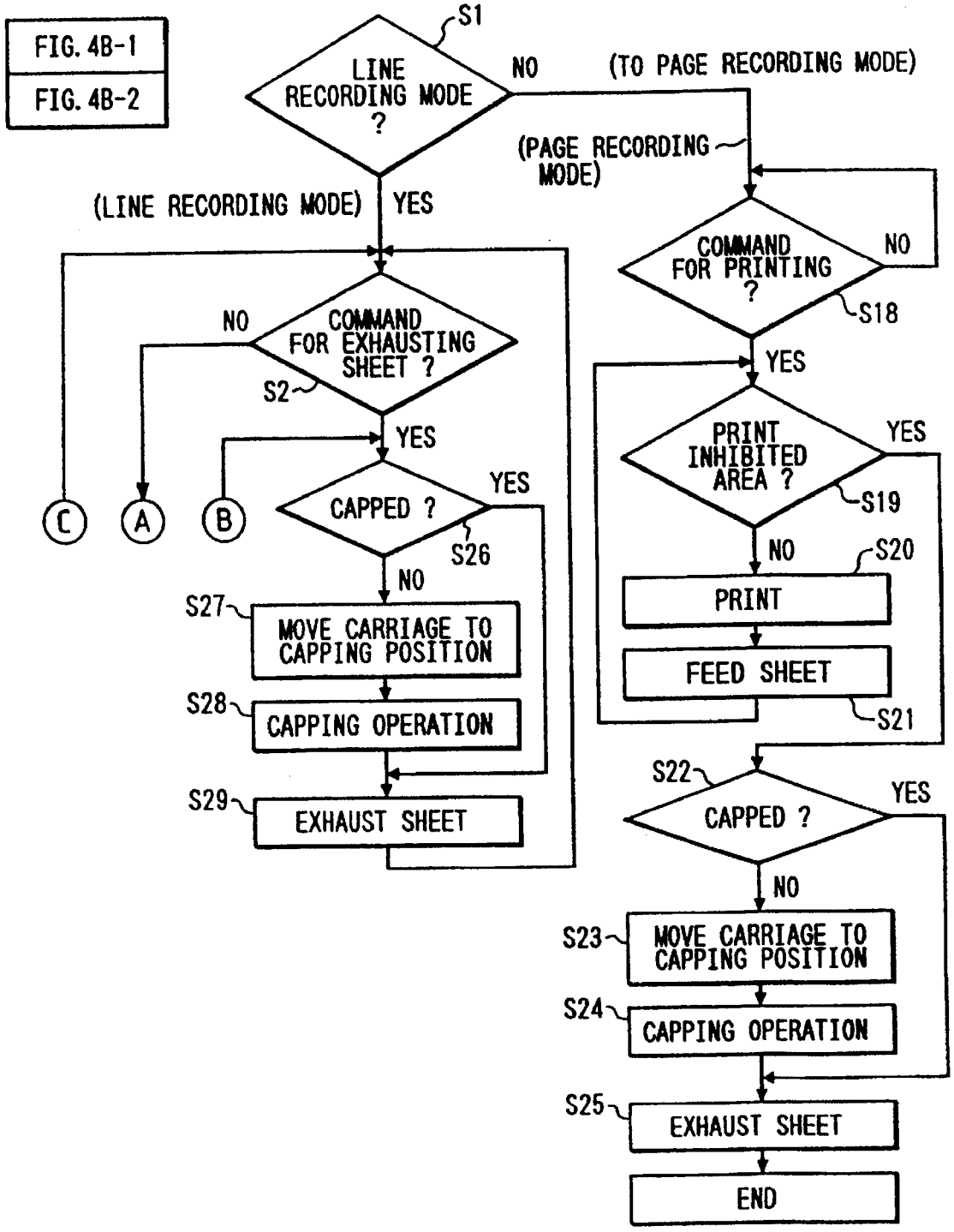
Figures 2, 4B:
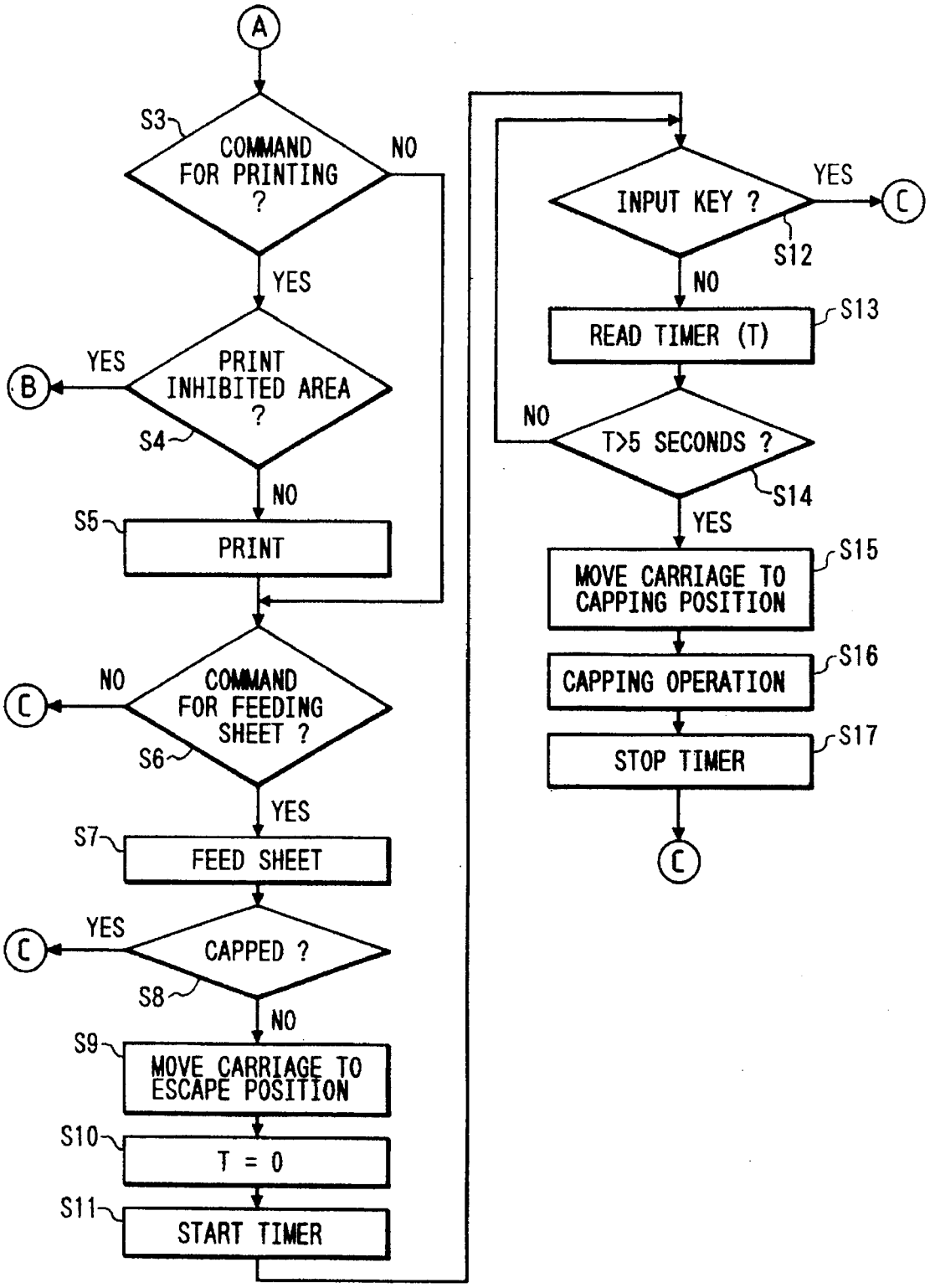

Here, the control example as previously described will be now described in detail with reference to FIG. 4B.

First, a recording sheet is supplied from the paper feed side. The recording sheet is conveyed by the conveying roller 33 to a recording area where recording is performed opposed to the recording head.

Next, recording is performed by the recording head as above mentioned, wherein this example operates in a line recording mode as a feature specific to the electronic typewriter, in addition to operating in a shift recording mode (page recording mode). Therefore, embodiments for control of the line recording mode and the page recording mode will be described for each respective mode.

First, the line recording mode will be explained. The line recording mode is a mode in which the recording is performed for every line, with the indication of a keyboard input, i.e., turning ON of the switch key 81. Thus, in the line recording mode, if an instruction for feeding paper arrives, for example, a line feed instruction arrives, recording is performed. The line recording mode will be described in detail with reference to the flowchart as shown in FIG. 4B.

At step S1, if the line recording is determined to be performed, the procedure proceeds to the line recording mode control. Next, at step S2, the apparatus determines whether a command for exhausting the sheet or not has been given, and if there is a command for exhausting the sheet, the procedure proceeds to step S26, in which after completion of the capping operation, the sheet is exhausted (steps S27, S28, S29). At step S2, if a negative determination is made, the procedure proceeds to step S3, where the apparatus determines whether a command for printing or not has been given. If the command for printing is determined to have been given, the procedure proceeds to step S4, where the apparatus determines whether a print inhibited area or not has been determined. And if the print inhibited area has been determined, the procedure proceeds to step S26, or otherwise, a print operation is performed (step S5), and then the procedure proceeds to step S5. At step S3, if a negative determination is made, the procedure proceeds directly to step S6. At step S6, the apparatus determines whether a command for feeding a sheet or not has been given, and if not, the procedure proceeds to step S2. If a command for feeding a sheet is determined to have been given, a sheet is fed (step S7), and then the procedure proceeds to step S8. At step S8, the apparatus determines whether or not the recording head is capped, and if it is capped, the procedure returns to step S2. And if it is not capped, the carriage 11 is moved to an escape position (step S9). The escape position is provided outside of the conveyance passage for the recording medium, or it can be a position for the capping operation. At the completion of movement to the escape position, the timer 101 is set at T=0, and started (steps S10, S11), and then the procedure proceeds to step S12. At step S12, the apparatus determines whether there has been a key input, and if there is a key input, the procedure proceeds to step S2. If there is no key input, the timer 101 is read (step S13), and then the procedure proceeds to step S14. AT step S14, the apparatus determines whether T>5 seconds, and if not, the procedure proceeds to step S12. If T>5 seconds, the capping operation is terminated (steps S15, S16), the timer 101 is stopped (step S17), and then the procedure returns to step S2.

Next, the control method in the page recording mode will be described. If a negative determination is made at step S1, the procedure proceeds to the page recording mode. At step S18, if the apparatus determines that a command for printing has been given, the procedure proceeds to step S19, where the apparatus determines whether the print inhibited area has been determined. And if not, the print operation is performed (step S20), a sheet is further fed (step S21), and the procedure returns to step S19. Note that if a print operation is repeated, the carriage 11 repeats the reciprocating motion from a home position for recording located in the conveyance passage of the recording sheet. At step S19, if a print inhibited area is determined, the procedure proceeds to step S22, in which after completion of the capping operation, the sheet is exhausted, and thus the series of operations are completed (steps S23, S24, S25).

By using the above-described control method, regardless of whether the line recording mode or the page recording mode is used, the recording head is kept from coming into contact with a trailing end portion of the recording sheet, and thus prevents staining of the recording sheet or damaging the ink discharge prot face of the head.

Figure 5:
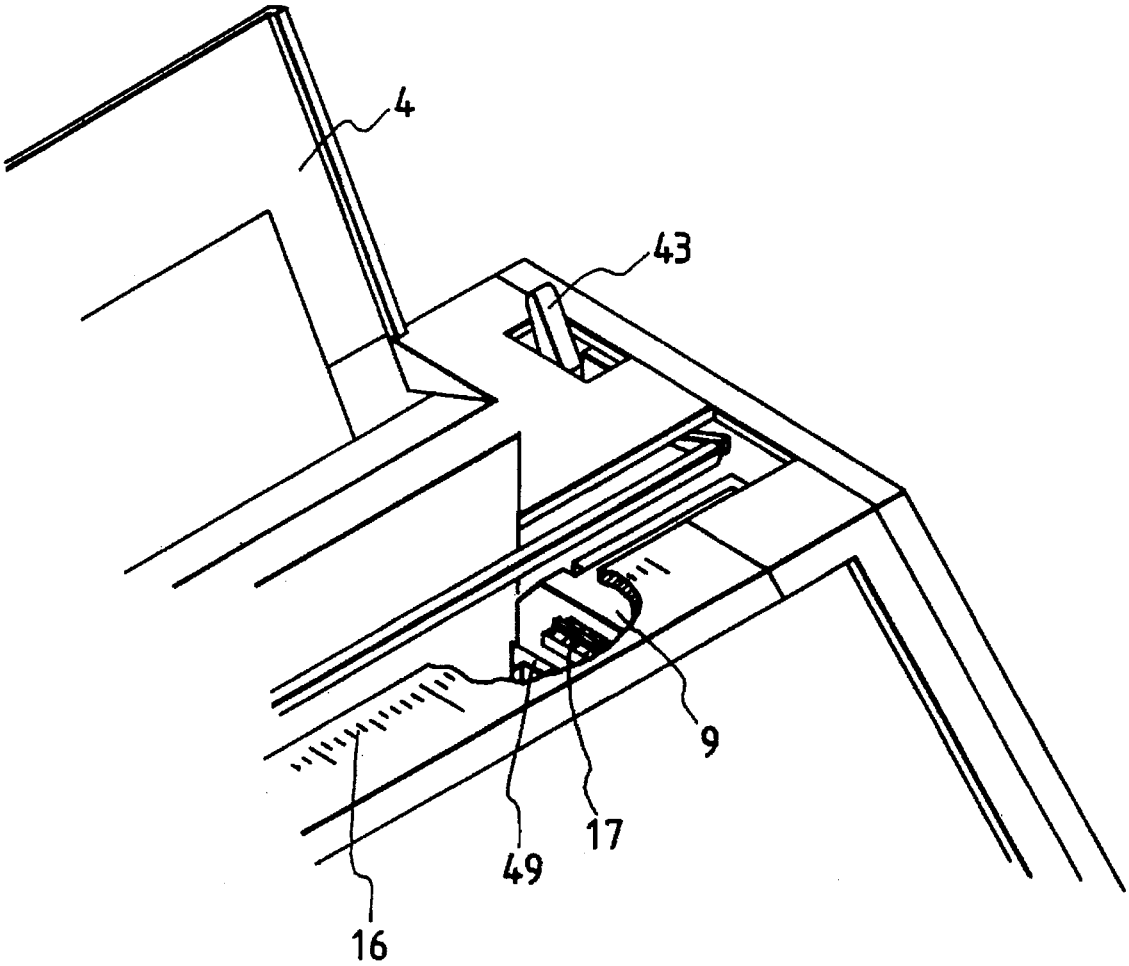
FIG. 5 is a partial external view of an electronic typewriter of this example.

FIG. 5 is a partial external view of an electronic typewriter according to the present invention. With reference to FIG. 5, a supplement is given for the explanation in connection with FIG. 1.

16 denotes a scale corresponding to the marker 17 as previously described, which is used to allow the reading of the print or set position with the recording head of the head cartridge 9.

Figure 6:
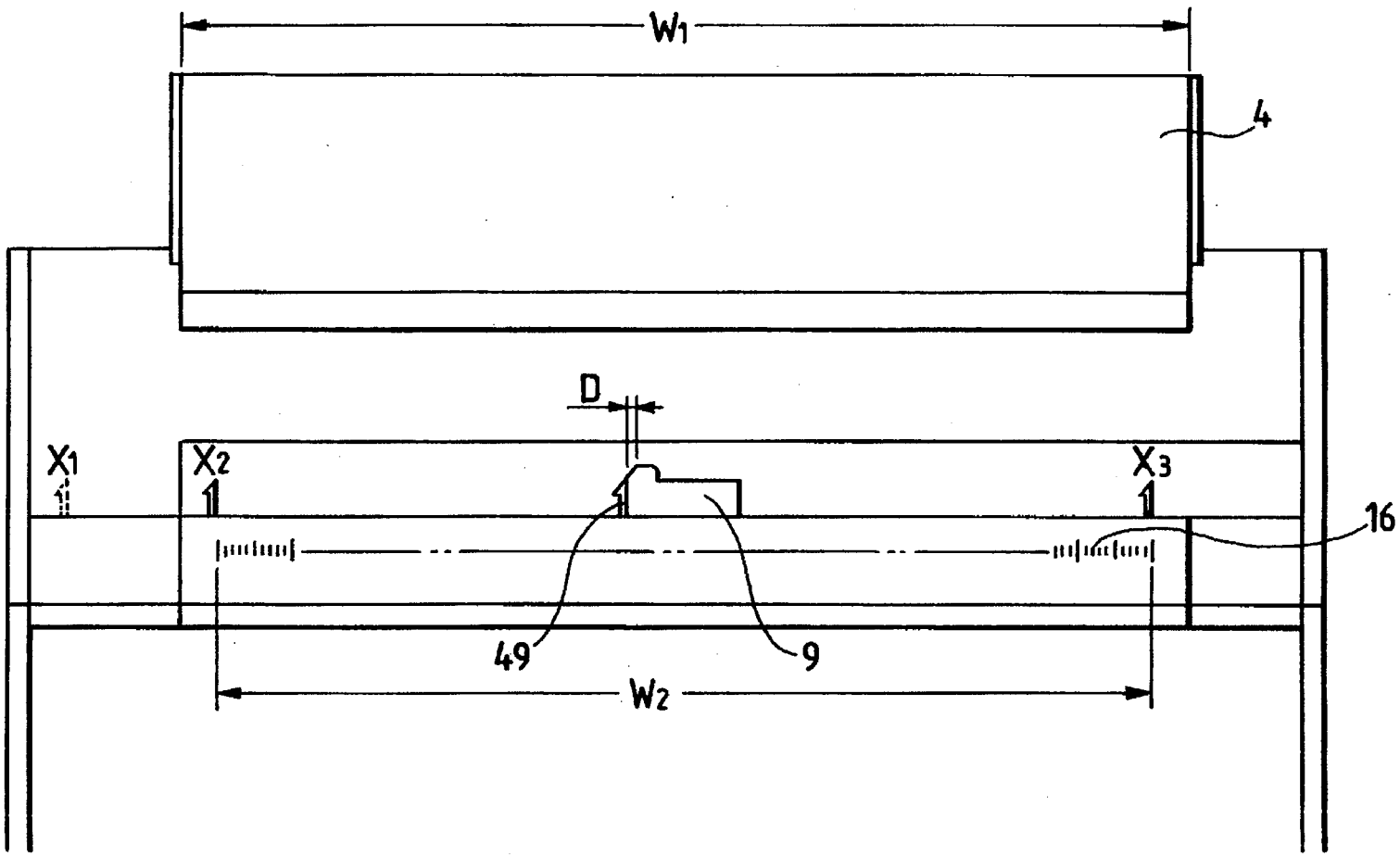
FIG. 6 is a schematic explanatory view from above of an electronic typewriter of this example.

FIG. 6 shows a schematic explanatory view from above of an electronic typewriter of this embodiment.

$W_1$ indicates the insertable range of the recording medium, and $W_2$ indicates the maximum print width.

$X_1$ indicates a home position, which is also used to perform the capping operation.

$X_2$ indicates a leftmost position for printing, and $X_3$ indicates a rightmost position in returning.

D indicates the distance between the marker 17 and the ink discharge ports of the recording head.

As described, this embodiment is constituted in such a manner that the recording head unit 9 can move up to the area at the rightmost position $X_3$ which is the maximum recording width for a recording sheet. And as this position is defined as the rightmost portion for the return area of the head 9, the head 9 can not be moved to a side area therefrom. Accordingly, in the side area, only the ink tank portion of the head cartridge 9 exists, so that it is possible to shorten the length of the recording apparatus in a width direction of the recording sheet.

By the way, the CPU 100 has settings for setting various types of recording modes, in which the following control operation can be performed on the set mode.

An electronic typewriter of this example can set a line recording mode for recording for every line, and a shift recording mode (also called as a page recording mode) for recording several lines once over a predetermined area, as previously described.

In the line recording mode as previously described, the recording head is turned to the home position every time one line is recorded, and then the recording sheet is conveyed. With such a constitution, even if the sensor does not detect a trailing end portion of the recording sheet, the recording head and the trailing end portion of recording sheet are never brought into contact. On the other hand, in the shift recording (page recording) mode, recording may be sometimes performed over a next recording sheet near a trailing end portion of the recording sheet. In such a recording operation, the aforementioned control must be performed by detecting the trailing end portion of the recording sheet by the sensor. That is, a determination is made whether the recording head 9 is set in the line recording mode for recording for every line or the shift recording mode (page recording mode) for recording over a plurality of lines (in this case, it is determined by ON.OFF of the switch key 81 as previously mentioned.) And in the line recording mode in which the switch key 81 is ON, the discharge port face of the recording head 9 is moved outside of the conveyance passage of the recording sheet for every completion of one line. On the other hand, in the shift recording mode (page recording mode) in which the switch key 81 is OFF, to record over a plurality of predetermined areas, the recording head 9 is reciprocated in the conveyance passage of the recording sheet, and after the last line in the predetermined area as mentioned above has been recorded, the discharge port face of recording head 9 is moved outside of the conveyance passage of the recording sheet, and then the recording sheet is exhausted or conveyed.

As above described, since the electronic typewriter as described in this example can operate in various recording modes, scanning with the recording head and conveyance control of the recording sheet must be suitably performed in accordance with the recording mode. That is, the sensor for detecting the trailing end of recording sheet may be always operated, but it is not needed in certain recording modes. Therefore, it can be controlled such that, for example, when the line recording mode is selected, the trailing end detection cancel mode in which trailing end of recording sheet is not detected is selected, while when the shift recording mode (page recording mode) is selected, the trailing end detection mode in which trailing end is detected is selected.

It will be understood that the combination of modes for selecting a recording mode or whether or not the trailing end should be detected are within the scope of the present invention.

Thus, it is possible to resolve conventional problems by detecting the trailing end of a recording sheet, and in this connection, controlling the scanning with the recording head.

The present invention brings about excellent effects particularly in a recording head or a recording device of an ink jet system for recording by forming minute liquid droplets with heat energy. With such a method, higher density and definition recording can be accomplished.

As to its representative constitution and principle, for example, the one practiced by use of the basic principle disclosed in, for example, U.S. Pat. Nos. 4,723,129 and 4,740,796 is preferred. This system is applicable to either of the so-called on-demand type and the continuous type. The case of the on-demand type is particularly effective because, by applying at least one driving signal, which gives rapid temperature elevation exceeding the nucleus boiling point of the recording liquid, corresponding to the recording information, to electricity-heat converters arranged corresponding to the sheets or liquid channels holding a recording liquid (ink), heat energy is generated at the electricity-heat converters to effect film boiling in the recording liquid near the heat acting surface of the recording head, and consequently the bubbles within the recording liquid can be formed corresponding one by one to the driving signals. By discharging the recording liquid through an opening for discharging to the atmosphere, by the action force occurring as a result of the growth and shrinkage process of the bubble, at least one droplet is formed. By making the driving signals into pulse shapes, growth and shrinkage of the bubble can be effected instantly and adequately to accomplish discharging of the recording liquid so that the discharge has excellent response characteristics. As the driving signals of such a pulse shape, those as disclosed in U.S. Pat. Nos. 4,443,359 and 4,345,262 are suitable. Further excellent recording can be performed by employment of the conditions described in U.S. Pat. No. 4,313,124 concerning the temperature elevation rate of the above-mentioned heat acting surface.

The recording head can be constructed of the combination of the discharging orifice, the liquid channel, and the electricity-heat converter (linear liquid channel or right-angled liquid channel) as disclosed in the above-mentioned respective patents, or according to U.S. Pat. Nos. 4,558,333, or 4,459,600, which disclose having the heat acting portion arranged in the flexed region.

In addition, as to the serial-type recording head as above described, the present invention is effective for a recording head of the freely exchangeable chip type which enables electrical connection to the main device or the supply of ink from the main device by being mounted on the main device, or a recording head of the cartridge type having an ink tank integrally provided on the recording head itself, as previously described.

As regards the type or number of recording heads to be attached, for example, only a single head is provided corresponding to a chromatic color, or a plurality of heads may be provided corresponding to a plurality of inks differing in recording color or density.

As above described, if the trailing end detection means for the recording medium determines that the recording medium comes off a recording medium holding member and the recording medium comes into contact with the recording head, a determination is made whether the recording head is inside of the recording area, and only if it is inside thereof, the recording head is moved to the outside of the recording area, for example, on the left side, to thereby permit unimpeded conveyance of the recording medium. It is therefore, possible to prevent the discharge port face of the recording head from coming into contact with the trailing end portion of the recording medium.

And, with the above constitution, on the right side of recording apparatus, there is no need for a space in which the recording head can escape from the recording medium, whereby the recording apparatus can be miniaturized.

Furthermore, by selecting the detection of the trailing end of the recording medium in accordance with the recording mode, control of the recording can be simplified.

As above described, according to the present invention, it is possible to provide a recording apparatus in which a recording means may not carelessly come into contact with a recording medium and which can improve the recording speed, and an electronic typewriter having such a recording apparatus.

We claim:

1. An electronic typewriter recording image information on a recording medium having a trailing end portion, comprising:

a movable carriage for supporting a recording head for discharging ink onto the recording medium;

conveying means for conveying the recording medium;

driving means for driving said carriage mounting the recording head and said conveying means;

detection means for detecting the trailing end portion of the recording medium;

input means for inputting the image information to be recorded;

means for setting a line recording mode in which the image is recorded for every line, and a shift recording mode in which the image information inputted by said input means is recorded at one time;

trailing end detection cancel mode means for cancelling operation of said detection means for detecting the trailing end portion of the recording medium when the line recording mode is set; and trailing end detection mode means for setting a mode of operation in which said detection means detects the trailing end portion of the recording medium when the shift recording mode is set.

2. An electronic typewriter according claim 1, wherein the recording head is an ink jet recording head for discharging the ink by the use of heat energy.

3. An apparatus according to claim 1, wherein the recording head is an ink jet recording head for causing film boiling with the heat energy and discharging the ink through discharge ports by the growth of bubbles due to the film boiling.

4. An electronic typewriter according to claim 1, wherein the recording medium has a rightmost end portion, wherein said carriage travels to a return area opposed to the rightmost end portion of the recording medium.

5. An ink jet recording apparatus for recording on a recording medium using recording means for discharging ink through discharge ports on a discharge port face, said apparatus comprising:

a carriage for reciprocally moving the recording means for discharging ink in a direction across a conveyance passage of the recording medium;

decision mode means for deciding on a line recording mode in which the recording is made for every line or a page recording mode in which the recording is made for every page with the recording means; and execution means for, when a decision result of said decision mode means is the line recording mode, moving the discharge port face of the recording means out of the conveyance passage of the recording medium for every termination of recording of one line and, when the decision result of said decision mode means is the page recording mode, reciprocally moving the recording means retained in the carriage in a direction across the conveyance passage of the recording medium to record over a predetermined area and, after termination of recording of the predetermined area, moving the discharge port face of the recording means out of the conveyance passage of the recording medium, and then conveying the recording medium to exhaust the recording medium from said apparatus.

6. An ink jet recording apparatus according to claim 5, wherein said decision mode means decides on a mode based on a key operation of an operator.

7. An ink jet recording apparatus according to claim 5, wherein, in the page recording mode, when the recording means is reciprocated in the conveyance passage of the recording medium to record over a predetermined area, the carriage for moving the recording means repeats the reciprocating motion with the origin of a home position for recording in the conveyance passage of the recording medium.

8. An ink jet recording apparatus according to claim 5, further comprising a trailing end detection sensor for detecting a trailing end of the recording medium, and wherein said trailing end detection sensor operates in said page recording mode.

9. An ink jet recording apparatus according to claim 5, further comprising a carriage home sensor for recognizing the position of said carriage on which the recording means is mounted, and wherein said execution means can recognize the position of said carriage by the number of steps of a motor after the detection by said carriage home sensor.

10. An apparatus according to any one of claims 5 through 9, wherein said carriage has a return area on the rightmost end portion of the recording medium which is an area opposed to the recording medium.

11. An apparatus according to any one of claims 5 through 9, wherein the recording means has a head cartridge detachable from a main body of said apparatus which is integrally formed with a recording head and an ink tank for storing ink to be supplied to the recording head.

12. An apparatus according to any one of claims 5 through 9, wherein the recording means has an ink jet recording head for discharging the ink by using heat energy.

13. An apparatus according to any one of claims 5 through 9, wherein the recording means has an ink jet recording head for causing film boiling using heat energy for discharging the ink through discharge ports by the formation of bubbles due to the film boiling.

14. An apparatus according to any one of claims 5 through 9, wherein the page recording mode is a mode in which predetermined recording information to be recorded is recorded on the recording medium by a single command for printing.

15. An ink jet recording method for recording on a recording medium by the use of recording means for discharging ink through discharge ports on a discharge port face to record on the recording medium, said method comprising the steps of:

determining a line recording mode in which recording is made for every line or a page recording mode in which recording is made for every page; and controlling the recording means so that, in the line recording mode, the discharge port face of the recording means is moved outside of a conveyance passage of the recording medium for every termination of recording of one line and, in the page recording mode, the recording means is reciprocally moved in a direction across the conveyance passage of the recording medium to record over a predetermined area and, after termination of recording on the predetermined area, the discharge port face of the recording means is moved outside of the conveyance passage of the recording medium, and then the recording medium is conveyed for exhaust.

16. An ink jet recording method according to claim 15, wherein the recording means has an ink jet recording head for discharging the ink by using heat energy.

17. An ink jet recording method according to claim 15 or 16, wherein the recording means has an ink jet recording head for causing film boiling by using heat energy and for discharging the ink through the discharge ports by the formation of bubbles due to the film boiling.

18. An ink jet recording method according to claim 15 or 16, wherein the page recording mode is a mode in which predetermined recording information to be recorded is recorded on the recording medium by a single command for printing.

19. An ink jet recording method according to claim 17, wherein the page recording mode is a mode in which predetermined recording information to be recorded is recorded on the recording medium by a single command for printing.

20. An ink jet recording apparatus capable of moving an ink jet recording head in a recording area where ink is discharged through an ink discharge port to record along a recording surface of a recording medium having a rear end in a direction across a recording medium conveyance route, said apparatus comprising:

a carriage capable of moving an ink jet recording head in a recording area and in a direction across a conveyance route of the recording medium;

conveying means for conveying the recording medium in the conveyance route through the recording area;

an input section for inputting recording information for recording on the recording medium;

a detecting section for detecting the rear end of the recording medium;

a mode selecting section for selecting a line recording mode for executing recording on the recording medium for each input of one line from said input section or a page recording mode for recording recording information from said input section on the recording medium at a time after the recording information is inputted by said input section; and control means for controlling said conveying means to convey the recording medium responsive to said carriage having moved the ink jet recording head to position an ink discharge port of the ink jet recording head at a position deviated from a position opposed to the recording surface of the recording medium after each termination of recording for one line in the line recording mode, and for controlling said conveying means to exhaust the recording medium out of the recording area responsive to said carriage having moved the ink jet recording head to position an ink discharge port of the ink jet recording head at a position deviated from a position opposed to the recording surface of the recording medium in accordance with the detection of the rear end of the recording medium by said detecting section when the inputted information is recorded in the page recording mode.

21. A method for moving an ink jet recording head in a recording area where ink is discharged through an ink discharge port thereof to record along a recording surface of a recording medium having a rear end in a direction across a recording medium conveyance route, said method comprising the steps of:

moving the ink jet recording head in the recording area and in a direction across the conveyance route of the recording medium with a carriage;

conveying the recording medium in the conveyance route through the recording area with conveying means;

inputting recording information for recording on the recording medium with an input section;

detecting the rear end of the recording medium with a detecting section;

selecting a line recording mode for executing recording on the recording medium for each input of one line from the input section or a page recording mode for recording recording information from the input section on the recording medium at a time after the recording information is inputted by the input section; and controlling the conveying means to convey the recording medium responsive to the carriage having moved the ink jet recording head to position an ink discharge port of the ink jet recording head at a position deviated from a position opposed to the recording surface of the recording medium after each termination of recording for one line in the line recording mode, and controlling the conveying means to exhaust the recording medium out of the recording area responsive to the carriage having moved the ink jet recording head to position an ink discharge port of the ink jet recording head at a position deviated from a position opposed to the recording surface of the recording medium in accordance with the detection of the rear end of the recording medium by the detecting section when the inputted information is recorded in the page recording mode.

22. A method according to claim 21, further comprising the step of reciprocating the carriage for recording in the conveyance route of the recording medium in the page recording mode.

23. A method according to claim 21, wherein the ink jet recording head is part of a recording apparatus comprising a motor driven through a number of steps to drive the carriage, a central processing unit and a carriage sensor for recognizing the position of the carriage, said method further comprising the step of determining with the central processing unit the position of the carriage by the number of steps performed by the motor after detection by the carriage sensor.

24. A method according to claim 21, wherein the recording head is part of a recording apparatus comprising rear end detection cancel mode means for cancelling operation of the detecting section when the line recording mode is set, and rear end detection mode means for setting a mode of operation in which the detecting section operates when the page recording mode is set, said method further comprising the steps of detecting a rear end portion of the recording medium with the detecting section, cancelling operation of the detecting section when the line recording mode is set, and actuating the operation of the detecting section when the page recording mode is set.

25. A method according to claim 21, wherein the recording medium has a rightmost end portion, wherein said method further comprises the step of moving the carriage to a return area opposed to the rightmost end portion of the recording medium.

* * * * *

UNITED STATES PATENT AND TRADEMARK OFFICE

CERTIFICATE OF CORRECTION

PATENT NO. : 5,644,348

DATED : July 1, 1997

INVENTOR(S) : SHIMOYAMA ET AL.

It is certified that error appears in the above-identified patent and that said Letters Patent is hereby corrected as shown below:

ON THE COVER PAGE

AT [56] References Cited, Other Publications
"Technical;" should read --Technical--.

[56], References Cited, Other Publications
"no. 5" should read --no. 5,--.

COLUMN 3:
Line 53, "be also" should read --also be--.

COLUMN 5:
Line 41, "is provided" should be deleted.

Line 44, "a electronic" should read --an electronic--.
Line 65, "be now" should read --now be--.

COLUMN 6
Line 38, "of" should read --of the--.
Line 53-54, "be now" should --now be--.

COLUMN 7
Line 42, "AT" should read --At--.

COLUMN 8
Line 2, "prot" should be --port--.
Line 35, "as a" should read --a--.
Line 43, "recording" should read --the recording--.
Line 55, "mentioned.)" should read --mentioned).

UNITED STATES PATENT AND TRADEMARK OFFICE

CERTIFICATE OF CORRECTION

PATENT NO. : 5,644,348

DATED : July 1, 1997

INVENTOR(S) : SHIMOYAMA ET AL.

It is certified that error appears in the above-identified patent and that said Letters Patent is hereby corrected as shown below:

COLUMN 9

Line 6, "recording" should read --the recording--.

Line 10, "trailing" should read --the trailing--; and "recording" should be --the recording--.

Line 13, "trailing" should read --the trailing--.

COLUMN 10

Line 21, "recording" should read --the recording--.

Line 59, "according" should read --according to--.

Signed and Sealed this

Twenty-eighth Day of April, 1998

Bruce Lehman

*Attest:*

BRUCE LEHMAN

*Attesting Officer*

*Commissioner of Patents and Trademarks*